United States Patent [19]

Edelmann et al.

[11] 4,352,262

[45] Oct. 5, 1982

[54] METHOD OF SEALING CRACKS AND APPARATUS THEREFOR

[76] Inventors: Frank E. Edelmann, 344 N. Park Rd., LaGrange Park; James R. Post, 147 N. Park Rd., LaGrange, both of Ill. 60525

[21] Appl. No.: 178,877

[22] Filed: Aug. 18, 1980

[51] Int. Cl.[3] ..... E04B 1/41

[52] U.S. Cl. ..... 52/744; 52/173 R; 52/514; 52/749

[58] Field of Search ..... 52/744, 173 R, 514, 52/704, 743, 749

[56] References Cited

U.S. PATENT DOCUMENTS

| | | | |
|---|---|---|---|
| 1,883,196 | 10/1932 | Wertz | 52/514 X |
| 2,074,566 | 3/1937 | Sheils | 52/744 |
| 2,187,324 | 1/1940 | Many | 52/744 X |
| 3,371,459 | 3/1968 | Thomas et al. | 52/744 X |
| 4,044,512 | 8/1977 | Fischer et al. | 52/704 X |
| 4,120,128 | 10/1978 | Pauls | 52/173 R |
| 4,269,014 | 5/1981 | Grammerst . | |

FOREIGN PATENT DOCUMENTS

| | | | |
|---|---|---|---|
| 29051 | 6/1957 | Finland | 52/744 |

*Primary Examiner*—J. Karl Bell

*Attorney, Agent, or Firm*—Rogers, Eilers & Howell

[57] ABSTRACT

A method of repairing cracks in a concrete structure to prevent leakage wherein rods are inserted in the crack at spaced intervals to extend outwardly therefrom. A surface seal is applied to extend partially into the crack near the structure outer surface from which the rods extend, and to the structure outer surface adjacent to the crack and around the rods so that the surface seal acts as a surface barrier for the filler to be injected. Port members, having hollow shaft portions, and a flange portion are placed over the rods with the flange portions approximately adjacent the structure outer surface. Substantially the entire flange portion is embedded in the surface seal. The surface seal is allowed to cure to define a surface barrier for the filler, and the rods are removed from the crack and port members such that the ports communicate with the crack cavity behind the surface seal. After the surface seal cures, a filler is injected through the port members and into the crack cavity, and the port members are plugged.

A port and plug assembly for use in sealing the cracks has a hollow shaft portion and a flange portion at one end thereof. The flange defines the base of the port member and is generally flat with the shaft extending from only one side of the base, the base being adapted to be embedded in a surface seal in the crack sealing method.

11 Claims, 8 Drawing Figures

FIG. 6.
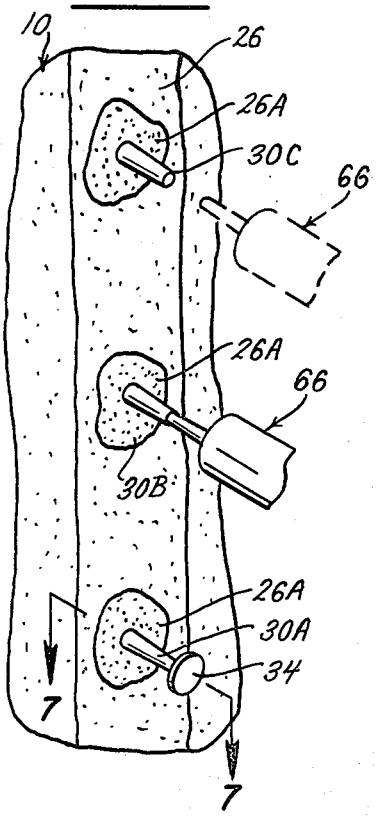
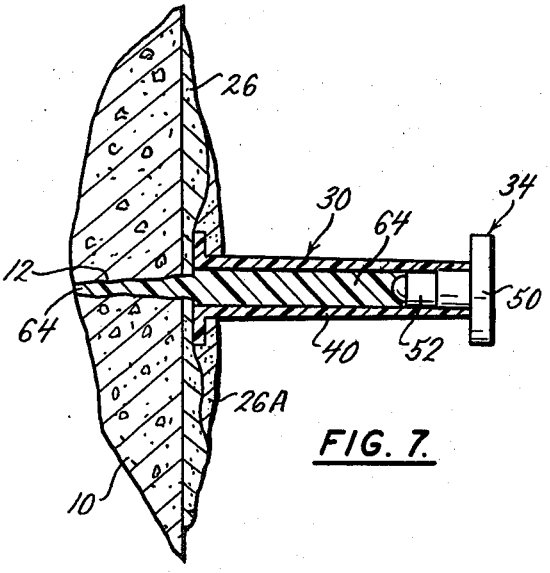
FIG. 7.
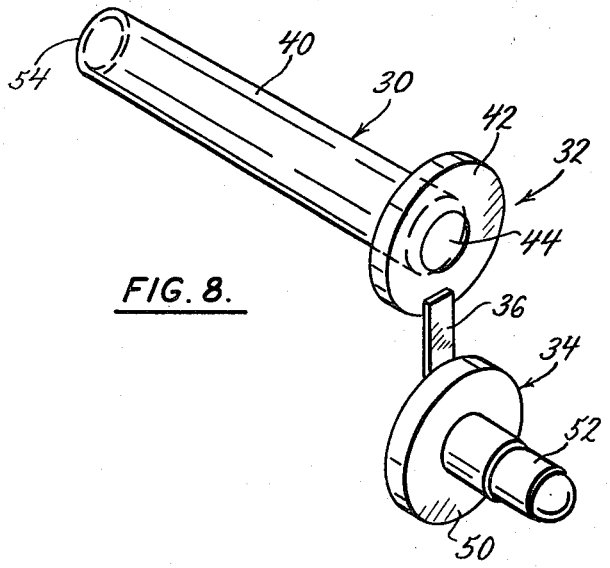
FIG. 8.

METHOD OF SEALING CRACKS AND APPARATUS THEREFOR

BACKGROUND AND SUMMARY OF THE INVENTION

This invention relates to a method of repairing cracks in concrete structures such as precast or cast in place flooring, walls, beams, or the like, or generally any formed concrete for structural strength and to prevent leakage. The invention also relates to a port and plug assembly for use in the method.

Various methods have been used for repairing such cracks, but the one previously known to applicants and believed to be the most effective, involved the use of epoxies to seal the surface of the crack and to inject into the crack cavity behind the surface seal through port assemblies. Heretofore, the port assemblies each had a hollow shaft portion with an enlarged frustoconical portion at one end thereof. A series of holes were drilled at spaced locations along the crack to be sealed, and the frustoconical ends of the port assemblies were inserted in the drilled holes. An epoxy surface seal was then applied partially into the crack and into the holes over the frustoconical ends of the port assemblies. The surface area of the concrete structure adjacent the crack was also covered with the surface seal, so that after curing, the surface seal acted to hold the port assemblies in place and as a surface barrier for an epoxy filler. After the surface seal had cured, the epoxy filler was injected through the ports and into the crack cavity behind the surface seal for structural strength and to effectively seal the crack against leakage. Generally, the technique was to first inject filler through one port until the filler appeared at the next port, whereupon the first port was plugged and filler was injected into the next port, and so on until the entire crack cavity was filled and all of the ports were plugged.

The present invention represents an improvement over this method and port assembly. While the previous method was very effective in sealing cracks, it was relatively labor intensive as compared with the method of the present invention in that it required the drilling of holes along the crack, along with additional related drilling, coring, and vacuuming equipment. As the method is used primarily with concrete structures, the drilling of the holes was time consuming and often tedious. The holes had to be accurately placed over the crack and had to be sized to receive the frustoconical end of the port assemblies. For example, on an eight inch (20.32 cm) thick, eight foot (243.8 cm) high wall with a crack extending the full height, the holes might typically be placed about eight inches ((20.32 cm) apart, requiring the drilling of twelve such holes. Furthermore, concrete dust from the drilling often clogged the crack and had to be removed requiring additional time and equipment. The problem is multiplied where there are multiple cracks.

The present invention eliminates the problem of the prior method. The port and plug assembly of the present invention, rather than having a frustoconical portion, has a generally flat flange at one end of the hollow shaft which is embedded in the surface seal at a location over the crack and generally adjacent the outer surface of the structure to which the surface seal is applied. The flat configuration of the flange allows for a smooth application of the surface seal over the flange so as to embed substantially the entire flange in the surface seal where it becomes thoroughly captured and sealed therein when the surface seal cures. Thus, the surface seal itself acts to capture and hold the port assemblies, as well as sealing the outer surface of the crack, without the need for the labor intensive and tedious drilling of holes in the concrete structure which weaken the structure. The present invention virtually eliminates the need for expensive pumps and related drilling and vacuuming equipment.

In accordance with the method of the present invention, rods are inserted into the crack at the location where the holes of the prior method would have been placed. The rods act to properly locate the port assemblies which are to be placed thereover. After the rods are in place, the surface seal is applied partially into the crack opening near the wall surface from which the rods extend, around the rods themselves, and onto the wall surface adjacent the crack. The port and plug assemblies with plugs removed are placed over the rods and the relatively flat flanges of the port assemblies are embedded and covered substantially in their entirety into the surface seal. The surface seal is allowed to cure and the rods are removed so that each port assembly communicates with the crack cavity behind the seal. After the surface seal cures, epoxy filler is injected into the port assemblies, using safe low pressure hand held tools, and the port assemblies plugged as with the prior method. By the use of the rods, the port assemblies are accurately placed over the crack for ease in injecting the filler, and no drilling is required to locate the ports.

Thus, it is a primary object of the present invention to provide a method of repairing cracks in structures, primarily concrete structures, and a port and plug assembly for use therewith, which is not only effective in repairing such cracks, but which is relatively easy, less time consuming, and which provides for accurate placement of the port assemblies, and with no loss in structural strength or decrease in structural integrity, for injection of the filler and substantially thorough and complete sealing of the crack.

This and other objects of the invention are apparent from the drawing and detailed description to follow.

DESCRIPTION OF THE DRAWING

FIG. 6 is an isometric view similar to that of FIG. 4 but showing additional steps in the process;

FIG. 7 is an enlarged view in section taken generally along the line 7—7 of FIG. 6; and FIG. 8 is an isometric view of the port and plug assembly of the present invention for use in the process.

DETAILED DESCRIPTION OF A PREFERRED EMBODIMENT

Figure 1:
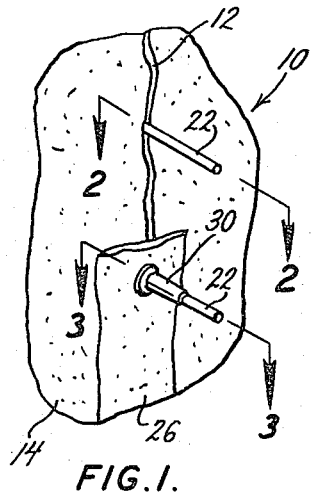
FIG. 1 is an isometric view showing a typical wall crack and partial application of the method of the present invention, including rod and port assembly, with portions broken away for illustration.
Figure 2:
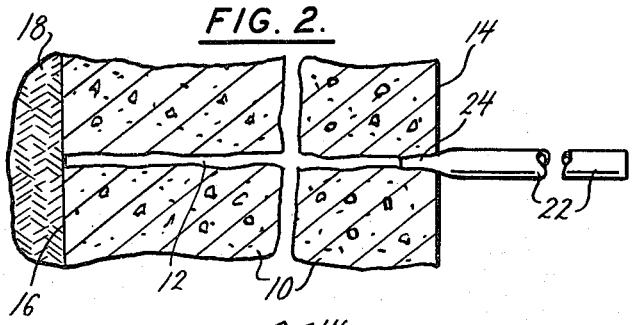
FIG. 2 is an enlarged view in section taken generally along the line 2—2 of FIG. 1.
Figure 3:
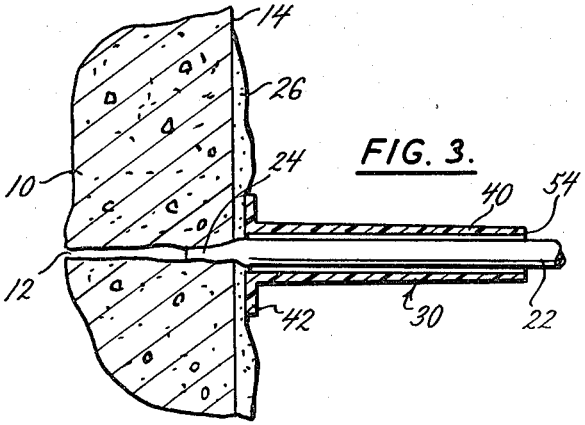
FIG. 3 is an enlarged view in section taken generally along the line 3—3 of FIG. 1.
Figure 4:
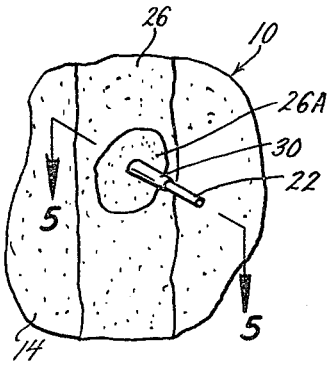
FIG. 4 is an isometric view similar to that of FIG. 1, but showing completion of an additional step in the process.
Figure 5:
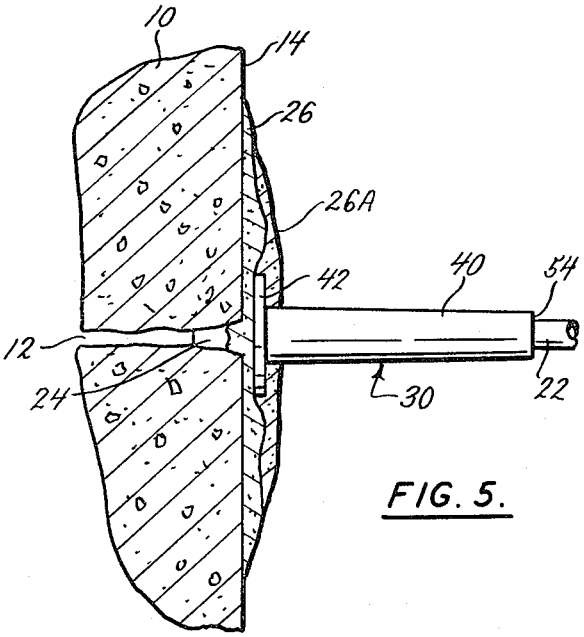
FIG. 5 is an enlarged view in section taken generally along the line 5—5 of FIG. 4.

With reference to the drawing, there is shown a portion 10 of a typical concrete wall having a crack 12 therein. A concrete wall has been used in this preferred embodiment as it is a type typically repaired by the method of this invention, however, other concrete structures could also be repaired by this method, such as floors, decks, structural members such as beams and virtually all types of concrete structures. The wall 10, for example, might be the basement wall of a building that has cracked from settling. Typically, such a wall has a front surface 14 from where the repair will be made, and a back surface 16 typically backfilled with dirt 18, rock, or the like.

The crack near the wall surface 14 is first prepared by cleaning the crevice of loose material and dirt. The wall surface 14 is roughened, such as with a wire brush or the like, adjacent the crack opening for better adhesion of the surface seal to be applied. Loose material produced from roughing the surface may be removed by patting the crack area with a cupped hand versus high pressure air or the like. A series of rods 22 are then placed in the crack at spaced intervals with one end of the rod inserted part way into the crack opening as at 24 and wedged therein so that the rod extends generally outwardly from the wall surface 14. The length of the rod 22 is such that it extends sufficiently outwardly from the wall to support a port member to be described. It has been found that a standard soda straw, such as a small plastic straw, works very well for this purpose. The end of the straw is pinched and inserted in the crack opening. Such straws are very inexpensive and readily available.

The rods 22 act as locators to ensure that the port members to be described are properly located directly over the crack opening, and further act to define port openings so that the port members communicate with the crack cavity within the wall.

By way of example, in a wall eight inches (20.32 cm) thick, the rods 22 may be spaced approximately eight inches (20.32 cm) apart, a rule of thumb being to space the rods a distance approximately that of the wall thickness. The spacing may be less or greater as required to provide enough ports for filling substantially the entire crack cavity.

After the rods 22 are in place, a surface seal 26 is applied partially into the crack near the wall surface 14, around each of the rods 22, and over that portion of the wall surface 14 adjacent the crack, so that upon curing, the surface seal defines a surface barrier for the filler to be injected into the crack cavity.

Before the surface seal cures, the port members 30 of port and plug assemblies 32 are placed over the rods 22 after removal of the plug.

The port and plug assembly 32 (FIG. 8) also has a plug member 34 attached to the port member 30 by a tether 36. The port member has a hollow slightly tapered shank portion 40 of generally annular cross section, and a flat, disc shaped, flange or base portion 42 with an opening 44 aligned with the opening through the shank 40. The inner surface of the shank and that of the opening 44 are relatively smooth for ease in injecting the filler material therethrough, and the shank 40 extends from only one side of the base or flange portion 42 so as not to interfere with proper placement of the port assembly near the wall surface 14 as will be described.

The plug member also has a generally flat disc shaped portion 50 and a stub shaft 52 extending from one side, and generally at the center, thereof. The outer end of the stub shaft 52 is of slightly less diameter than the portion of the stub shaft nearest the disc 50 for ease in inserting the shaft 52 in the free end 54 of the port member. The entire port and plug assembly, including the tether 36 is of molded one piece construction, and is preferably made from a relatively transparent material such as for example, polycarbonate.

By way of example, the port and plug assembly may have the following approximate dimensions:

port member:
- shank length: 45 mm
- shank ID: 6.5 mm
- shank OD at free end: 8 mm
- shank OD at base: 10 mm
- base OD: 20 mm
- base ID: 6.5 mm
- base thickness: 1.8 mm plug member:
- shaft length: 13 mm
- shaft OD near flange: 6.5 mm
- shaft OD near end: 6 mm
- flange diameter: 20 mm
- flange thickness: 3 mm tether:
- length: 13 mm
- width: 3.5 mm
- thickness: 0.8 mm Before placement of the port members, the plugs 34 are removed by simply pulling the tethers 36 from the port members. The port members are then placed over the rods with the flat base portion 42 nearest the wall. The port members are pressed into the still uncured surface seal until the flat base member is near or substantially adjacent the wall surface 14. After the port members are in place over the rods 22, additional surface seal 26A is applied over the base portions of the port members and smoothed or flared into the previously applied surface seal 26 to embed substantially the entire base portion in the surface seal. While the surface seal 26A can be applied after the surface seal 26 has cured, it is preferable to apply it before curing. This method reduces surface pressure on the port assembly base and allows for higher injection pressures where required (for example 100 psi [7033 gm per square cm]).

The surface seal is preferably an epoxy such as of the type sold by The Ostarr Corporation of America, 623 S. LaGrange Road, LaGrange, Ill. 60525, or its authorized distributors, under the trade name OSTARR SURFACE SEAL, or similar product. The surface seal is preferably a two component epoxy, one of the components being a curing agent, which when mixed together initiates the curing process. The epoxy should have the characteristics of minimal shrinkage and good bonding to concrete surfaces. It should become hard when cured and act as a seal for the filler to be injected. The surface seal should adhere well to both dry and moist concrete surfaces. Such epoxies are readily available and known to those skilled in the art.

After application, the surface seal is allowed to cure until it forms an effective surface barrier for the filler to be injected. The rods 22 are removed after the surface seal has cured sufficiently so as not to have the surface sealer run between the wall and port member and close off the opening from the port to the crack cavity. After the rods are removed and the surface seal has cured, a filler 64 is injected through the ports and into the crack cavity. The filler material is preferably an epoxy, and for example, may be a product sold by The Ostarr Corporation under the trade name OSTARR INJECTION RESIN, or a similar product. The filler material is preferably a non-shrink two component epoxy, one of the components being a curing agent, which when mixed together initiates the curing process. It is preferably of sufficiently low viscosity so that it may be injected through the ports at relatively low pressure, such as for example approximately 14–100 psi (983–7033 gm per square cm). It should have excellent flow characteristics and bond well to both dry and moist concrete surfaces. Upon curing, it should be impervious to water and other fluids. Such epoxies are well known in the art and readily available.

Such a product may be in cartridge form with a suitable nozzle (such as cartridge and nozzle assembly 66), that fits within the outer opening of port member for injection of the resin filler into the cavity.

A typical procedure for injecting the resin 64, such as in a vertical crack, is to begin with the lowest port member 30A (FIG. 6). Resin is injected into port 30A until it is visible in, or begins leaking from, the next highest port 30B. The transparency of the port members allows for visibility of the resin movements during injection. Visibility of the resin at the port member 30B is an indication that the crack cavity between ports 30A and 30B is filled. The port 30A is then plugged with a plug member 34, and resin is then injected into the port member 30B until it appears, or leaks from, the port member 30C. The port 30B is plugged and the process continues from port to port until the entire cavity is filled. Variations of this procedure, depending on the various conditions and types of cracks, will be evident to those skilled in the art. For example, there may be situations where it is best to skip one or more ports during the filling process or go from a higher port back to a lower port. Hence, the sequence of injecting the filler in the ports may vary depending on conditions. Eventually, substantially the entire crack cavity is filled and all ports are plugged. The filler resin is allowed to cure to effectively seal the crack against moisture and strengthen the structure. The ports then may be left in place, or may be severed at the wall surface as desired.

It will be noted that where there is a back fill, such as the back fill 18, the back fill acts as a barrier at the other side of the wall to prevent the resin filler from running out the back side of the crack. If the wall is open at the backside, a suitable surface seal, such as the surface seal 26, will have to be applied over the crack at the backside of the wall to act as a surface barrier during the filling process.

The above procedure is followed in sealing relatively dry cracks. Where a crack is wet, some additional steps must be taken to dry the crack near the wall surface 14 so that the surface seal will adhere to the wall. To divert the water from the wall surface, the rods 22 should be hollow allowing the water to pass through the rod and out the outer end. Once again, an ordinary soda straw is suitable for this purpose. The wall surface 14 at the crack is then dried with a suitable blower or the like, and then the outer crack cavity is filled with a fast setting hydraulic cement. After the cement dries, the surface seal 26 is applied and the procedure is followed as heretofore described.

For cracks that are relatively wide at the wall surface 14, such as for example over about five mm, a epoxy resin of higher viscosity may be used. Such material may be of the type sold by The Ostarr Corporation, or its authorized distributors, under the trade name OSTARR WIDE CRACK GELL or similar product. It has generally the same properties as the epoxy resin for narrow cracks, but is of a higher viscosity. For cracks that are in a corner of a concrete structure, the port base 42 must be snipped on two sides by using a side cutter or similar tool. This allows the port base 42, which is now approximately rectangular, to be placed closer to the crack, when installed over the rod 22.

It will be seen that by the present invention, the port members are quickly, easily and accurately located directly over the crack, and securely held in place by the surface seal without the need for drilling holes in the concrete structure.

There are various changes and modifications which may be made to applicants' invention as would be apparent to those skilled in the art. However, any of these changes or modifications are included in the teaching of applicants' disclosure and they intend that their invention be limited only by the scope of the claims appended hereto.

We claim:

1. A method of repairing cracks in structures, particularly of concrete, to prevent leakage and structural deterioration, comprising the steps of:

inserting rods in the crack at spaced intervals therealong, said rods being inserted with one end bound within the crack to support the rod with a portion of the rod extending outwardly from the outer wall surface, the portion of the rod extending from said wall being of sufficient length to support a port member thereover;

applying a surface seal so as to extend partially into the crack near the outer wall surface and to cover the wall surface adjacent the crack and around the rods, so that the surface seal defines a surface barrier for the filler to be injected;

placing port members having hollow shaft portions and a flange portion over said rods with the flange portions near the wall surface and at least partially embedded in said surface seal;

applying surface seal over said port member flanges and onto said previously applied surface seal to embed substantially the entire flange in said surface seal;

allowing said surface seal to cure to define an outer wall surface barrier for the filler to be injected, and removing the rods from the crack and port members, the port members then defining ports communicating with the crack cavity behind the surface seal;

after allowing said surface seal to cure, injecting filler into the port members to fill substantially the entire cavity of the crack behind the surface seal; and plugging said port member after injecting said filler.

2. The method of claim 1 wherein said surface seal is applied over said port member flanges before the surface seal previously applied cures.

3. The method of claim 1 wherein the surface seal is an epoxy.

4. The method of claim 1 wherein the filler is an epoxy.

5. The method of claim 1 wherein said port member flanges are generally flat and said shaft portion is generally annular in cross section.

6. The method of claim 1 wherein said rods are removed after the surface seal cures.

7. A method of repairing cracks in structures particularly of concrete to prevent leakage and structural deterioration, comprising the steps of:

inserting rods in the crack to be sealed at spaced intervals therealong with said rods having a portion extending into the crack and a portion extending outwardly therefrom;

applying a surface seal over the crack at the outer wall surface and to cover the wall surface adjacent to the crack and around the rods, so that the surface seal defines a surface barrier for the filler to be injected;

placing port members over said rods and embedding portions of the port members in said surface seal;

removing the rods from the crack and port members, the port members then defining ports communicating with the crack cavity behind the surface seal; and injecting filler into the port members to fill the crack behind the surface seal.

8. The method of claim 7 wherein said port members have flanges, said port members being placed over said rods with the flanges near the wall surface, substantial portions of said flanges being embedded in said surface seal.

9. The method of claim 7 wherein the surface seal is an epoxy.

10. The method of claim 9 wherein the filler is an epoxy.

11. The method of claim 8 wherein said port member flanges are generally flat.

* * * * *